US006162024A

United States Patent [19]

Bruzek

[11] Patent Number: 6,162,024

[45] Date of Patent: Dec. 19, 2000

[54] CONSTANT HORSEPOWER CONTINUOUSLY VARIABLE VOLUME PUMP

[75] Inventor: Daniel A. Bruzek, Ellendale, Minn.

[73] Assignee: SPX Corporation, Muskegon, Mich.

[21] Appl. No.: 09/201,948

[22] Filed: Dec. 1, 1998

[51] Int. Cl.[7] ..... F04B 1/26

[52] U.S. Cl. ..... 417/222.1; 417/218; 417/222.2

[58] Field of Search ..... 417/212, 222.1, 417/222.2, 273, 274, 214, 270, 218

[56] References Cited

U.S. PATENT DOCUMENTS 3,657,970 4/1972 Kobayashi et al. ..... 91/485
3,712,758 1/1973 Lech et al. ..... 417/214

*Primary Examiner*—Philip H. Leung
*Assistant Examiner*—Thor Campbell
*Attorney, Agent, or Firm*—Hovey, Williams, Timmons & Collins

[57] ABSTRACT

A preferred constant horsepower, variable volume hydraulic pump (10) includes a wobble plate (22) coupled with interior end of the pump drive shaft (18) configured for sequentially stroking a plurality of pistons (28,30) received in respective cylinders (42,44) included as part of a nonrotatable barrel (24). A shifting mechanism (74) axially shifts the barrel (24) in accordance with the output pressure in order to change the stroke length of the pistons (28,30) in the cylinders (42,44) and thereby change the flow rate through the pump (10). The shifting mechanism (74) is configured to lower the flow rate as the output pressure increases in order to maintain a constant horsepower demand for maximizing the flow volume for a given horsepower.

15 Claims, 1 Drawing Sheet

CONSTANT HORSEPOWER CONTINUOUSLY VARIABLE VOLUME PUMP

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of pumps. More particularly, the invention is concerned with a constant horsepower, variable volume, hydraulic pump.

2. Description of the Prior Art

Constant power, variable volume pumps are used in those applications where it is desirable to maximize the flow volume for a given horsepower. Such applications include farm equipment, crimping and cutting operations, for example.

Prior art pumps of this type typically use a rotating barrel with pistons received in respective cylinders defined therein and a nonrotating wobble plate for stroking the cylinder pistons. The angle of the wobble plate is changed in order to change the flow rate through the pump. However, these prior art pumps generally have a maximum output pressure of about 5000 psi thereby limiting their utility.

SUMMARY OF THE INVENTION

The present invention solves the prior art problems mentioned above and provides a distinct advance in the state of the art. In particular, the pump hereof allows for pressures up to about 10,000 psi while using a design that is effective and reliable.

The preferred pump of the present invention includes a nonrotatable pump barrel having a plurality of cylinders, a respective plurality of pistons received in the cylinders, and a wobble plate coupled with the interior end of pump shaft and rotatable therewith to stroke the pistons. In preferred forms the barrel is axially shiftable along a mounting pin toward and away from the wobble plate.

A preferred shifting mechanism includes at least one spring that biases the barrel toward the wobble plate, which is the position for maximum piston stroke in the cylinders for maximum flow volume. The shifting mechanism also includes a pilot cavity defined in the mounting pin to provide outlet pressure to a pilot surface defined on the interior surface of the barrel next to the mounting pin. The pilot surface is configured to shift the barrel away from the wobble plate against the bias of the spring as the outlet pressure increases. Thus, as pressure increases, the lengths of the piston strokes in the cylinders decrease and so does the flow rate through the pump. The preferred shifting mechanism is configured to vary the flow rate sufficiently to maintain a constant, input horsepower demand in the preferred embodiment. Other aspects of the invention are disclosed herein.

DETAILED DESCRIPTION OF THE PREFERRED EMBODIMENT

Figures 1, 2:
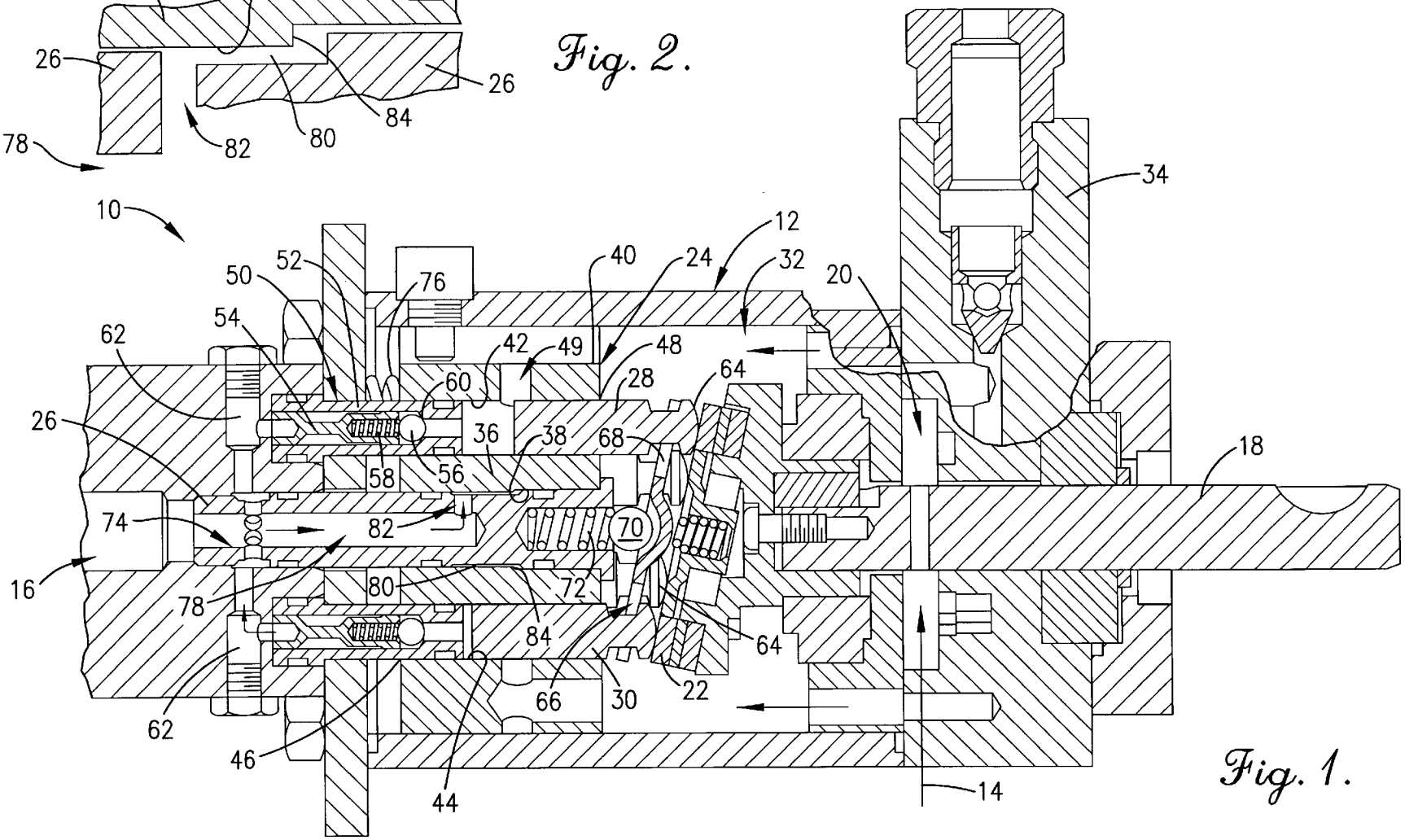
FIG. 1 is a side sectional view of the preferred pump in accordance with the present invention.
FIG. 2 is a sectional view of the pilot shift portion of the shifting mechanism of the pump of FIG. 1.

FIG. 1 is a sectional view illustrating preferred pump 10 in accordance with the present invention. Pump 10 broadly includes pump housing 12 having inlet 14 and outlet 16, pump shaft 18, gerotor 20, wobble plate 22, barrel 24 axially shiftable on mounting pin 26 and pistons 28 and 30.

Conventional gerotor 20 is connected to pump shaft 18, receives fluid through inlet 14, and delivers fluid at an increased charge pressure to inlet cavity 32. Poppet valve 34 controls the outlet charge pressure delivered by gerotor 20. Wobble plate 22 is connected to the interior end of pump shaft 18 within inlet cavity 32 as shown in FIG. 1.

Barrel 24 includes interior tubular wall 36 with central opening 38 defined therethrough. Opening 38 receives mounting pin 26 therein for axial shifting of barrel 24 therealong toward and away from wobble plate 22.

Barrel 24 also includes cylinder walls 40 defining six tubular cylinders evenly spaced round tubular wall 36. FIG. 1 illustrates two of these cylinders as cylinders 42 and 44. Each cylinder 42, 44 presents outlet end 46 and open end 48 with port 49 positioned therebetween to provide a fluid passage between inlet cavity 32 and a respective cylinder.

Pump 10 also includes six check valves 50 slidably received through the respective outlet ends 46 of the cylinders. Each check valve 50 includes valve body 52, ball guide 54, check ball 56 and spring 58. Tubular valve body 52 receives hexagonally shaped ball guide 54 therein. Check ball 56 is positioned between seat 60 defined as part of valve body 52 and ball guide 54. Spring 58 is received in ball guide 54 and biases ball 56 toward seat 60. One end of check valve 50 is slidably received through outlet end 46 of a respective cylinder to accommodate the axial shifting of barrel 24, and the opposed end of valve 50 is fixed to housing 12.

When check ball 56 shifts away from seat 60, fluid flows through the interstitial spaces between hexagonal ball guide 54 and circular valve body 52. Housing 12 includes six, evenly spaced, connection passages 62 extending radially from outlet 16, and fluidically coupled with the respective discharge ends of check valves 50.

Pump 10 includes six pistons illustrated by pistons 28, 30 received in the respective six cylinders of barrel 24 illustrated by cylinders 42, 44. Each piston is axially shiftable in a respective cylinder and presents outboard end 64 extending through open end 48 of the cylinder. Retainer assembly 66 biases the pistons into engagement with wobble plate 22. Assembly 66 includes retainer 68, bearing ball 70 and spring 72.

Retainer 68 clips to each piston adjacent the outboard end 64. Spring 72 is axially received in a corresponding hole defined in the distal end of mounting pin 26. Bearing ball 70 is positioned between spring 72 and retainer 68. Spring 72 pushes ball 70 and thereby retainer 68 toward wobble plate 22 so that the outboard ends of the pistons engage wobble plate 22.

Barrel shifting mechanism 74 operates to shift barrel 24 axially along mounting pin 26 in accordance with fluid pressure at outlet 16. Mechanism 74 includes twelve barrel springs positioned between housing 12 and the face of barrel 24 opposite wobble plate 22 in order to bias barrel 24 toward wobble plate 22. FIG. 1 illustrates one barrel spring 76.

Referring also to FIG. 2, mechanism 74 further includes pilot cavity 78 defined centrally through mounting pin 26 and fluidically coupled with outlet 16, groove 80 defined around mounting pin 26, pilot port 82 interconnecting cavity 78 and groove 80, and pilot surface 84 defined on the interior surface of tubular wall 36 of barrel 24 next to pin 26. The fluid pressure at outlet 16 is transmitted by way of cavity 78, port 82 and groove 80 to pilot surface 84. As the pressure outlet 16 increases, so does the pressure on pilot surface 84. This is a net force on barrel 24 and acts to shift barrel 24 against the bias of springs 76 away from wobble plate 22.

In use and operation, a conventional electric motor is connected to the exterior of pump shaft 18. The motor rotates shaft 18 which operates gerotor 20 to receive fluid by way of inlet 14 and to supply fluids so received at an increased charge pressure to inlet cavity 32.

Rotation of pump shaft 18 also rotates wobble plate 22 and strokes pistons 28, 30 axially in respective cylinders 42, 44. During the charging stroke, a piston moves away from open end 48 of a cylinder. As a result, fluid is drawn from cavity 32 through port 49 into the cylinder. FIG. 1 illustrates piston 28 at the end of the charging stroke.

Continued rotation of wobble plate 22 shifts the piston toward the outlet end 46 during a delivery stroke. FIG. 1 illustrates piston 30 at the end of the delivery stroke. During the delivery stroke, the piston displaces fluid from the cylinder through a respective check valve. In particular, the pressure of the fluid pushes check ball 56 away from seat 60 and toward ball guide 54 against the bias of spring 58. Fluid is discharged from the end of the check valve 50 into a corresponding connection passage 62 and from there to outlet 16.

FIG. 1 illustrates barrel 24 axially shifted toward wobble plate 22 in the maximum volume position under the bias of barrel springs 76. In this position of barrel 24, each piston undergoes the maximum length of stroke within its cylinder to deliver the maximum volume during the delivery stroke. It will be noted in FIG. 1 that a piston does not begin displacing fluid until it shifts past port 49.

Under load, the pressure at outlet 16 increases. This increased pressure is transmitted by way of cavity 78, port 82 and groove 80 to pilot surface 84. As the pressure increases, the pressure on pilot surface 84 shifts barrel 24 away from wobble plate 22 against the bias of barrel springs 76. When this occurs, the effective stroke length of each piston within a respective cylinder is decreased. That is, each piston must travel a greater length before closing off port 49. Thus, each piston undergoes a shorter stroke beyond port 49 thereby reducing the volume delivered during each delivery stroke and reducing the flow rate through pump 10.

As those skilled in the art appreciate, the input power requirement for a motor connected to pump shaft 18 is a function of the flow rate through pump 10 and the fluid pressure at outlet 16. In the preferred embodiment, the components are configured such that the input power requirement remains constant throughout the operating range of the pump. That is, as the fluid pressure at outlet 16 increases, barrel 24 is shifted enough so that the flow rate reduction is sufficient to maintain the input power requirement constant.

In one embodiment of the present invention, pump 10 is designed for a 1½ horsepower motor. This is a desirable motor size because this is a maximum that can be supplied by a conventional 120 VAC circuit. In this embodiment, pump 10 is configured to deliver hydraulic fluid between about 1,000 and 10,000 psi at a flow rate between about 2.6 and 0.26 gpm. In this way, the fluid volume delivered by pump 10 is maximized.

It will be appreciated that the present invention encompasses many variations in the preferred embodiment described herein. The pump could be configured other than a constant horsepower embodiment. For example, the pump could be configured for predetermined horsepower levels (power inputs) at various output pressures. In some circumstances, it might be desirable to reduce the input power at higher pressures, or to increase the input power at higher pressures. Also, the invention finds utility for pumping other types of fluids such as water, petroleum products, and other chemicals and even vapors in addition to hydraulic fluid. Having thus described the preferred embodiment of the present invention the following is claimed as new and desired to be secured by Letters Patent:

What is claimed is:

1. A pump comprising:

a housing having a fluid inlet and a fluid outlet defined therein;

a nonrotatable pump barrel positioned in said housing including laterally disposed cylinder walls defining a cylinder having a longitudinal axis, an outlet end fluidically coupled with said outlet, an opposed open end, and an inlet port defined in said cylinder walls between said open end and said outlet end and positioned to receive fluid from said inlet into said cylinder;

a piston received in said cylinder and presenting an outboard end extending through said open end of said cylinder, said piston being shiftable axially of the cylinder away from said outlet end during a charging stroke to draw fluid through said port into said cylinder, and axially shiftable towards said outlet end during a delivery stroke to displace fluid from said cylinder through said outlet end to said outlet;

a rotatable pump shaft having an interior end positioned in said housing; and a wobble plate coupled with said interior end of said shaft and rotatable therewith, said plate engaging said outboard end of said piston and configured to stroke said piston alternately between said charging and delivery strokes during rotation.

2. The pump as set forth in claim 1 including a plurality of said cylinders and respective pistons.

3. The pump as set forth in claim 2, said plate being operable to stroke said pistons in sequence.

4. The pump as set forth in claim 1, further including a gerotor positioned in said housing and operable to deliver fluid from said inlet to said cylinder by way of said port.

5. The pump as set forth in claim 1, said fluid including hydraulic fluid.

6. The pump as set forth in claim 1, said wobble plate being coupled with said outboard end of said piston.

7. The pump as set forth in claim 1, said barrel being axially shiftable toward and away from said wobble plate, said pump including a shifting mechanism fluidically coupled with said outlet and with said barrel to axially shift said barrel relative to said wobble plate, in order to change the stroke length of said piston in said cylinder and thereby change the flow rate through said pump, in accordance with a change in the fluid pressure at said outlet.

8. A pump comprising:

a housing having a fluid inlet and a fluid outlet defined therein;

a nonrotatable pump barrel positioned in said housing including cylinder walls defining a cylinder having an outlet end fluidically coupled with said outlet, an opposed open end, and an inlet port defined in said cylinder walls and positioned to receive fluid from said inlet into said cylinder;

a piston received in said cylinder and presenting an outboard end extending through said open end of said cylinder, said piston being axially shiftable away from said outlet end during a charging stroke to draw fluid through said port into said cylinder, and axially shiftable towards said outlet end during a delivery stroke to displace fluid from said cylinder through said outlet end to said outlet;

a rotatable pump shaft having an interior end positioned in said housing; and a wobble plate coupled with said interior end of said shaft and rotatable therewith, said plate engaging said outboard end of said piston and configured to stroke said piston alternately between said charging and delivery strokes during rotation, said barrel being axially shiftable toward and away from said wobble plate, said pump including a shifting mechanism fluidically coupled with said outlet and with said barrel to axially shift said barrel relative to said wobble plate, in order to change the stroke length of said piston in said cylinder and thereby change the flow rate through said pump, in accordance with a change in the fluid pressure at said outlet, said shifting mechanism including pilot structure to axially shift said barrel away from said wobble plate in order to decrease the stroke length from said piston and said cylinder and thereby lower the flow rate through said pump in accordance with an increase in said fluid pressure, and to enable shifting said barrel towards the wobble plate in order to increase the stroke length of said piston in said cylinder and thereby raise the fluid flow rate through said pump in accordance with a decrease in said fluid pressure.

9. The pump as set forth in claim 8, there being a input power requirement as a function of said flow rate and fluid pressure at said outlet for rotating said input shaft and thereby operating said pump, said shifting mechanism including means for shifting said barrel in order to maintain said input power requirement substantially constant over a range of said flow rate and fluid pressure thereby maximizing the amount of fluid delivered by said pump through said outlet for a given power input.

10. The pump as set forth in claim 9, said shifting means including biasing means biasing said barrel toward said wobble plate, and including structure defining and interior pilot surface on said barrel and defining a passage fluidically coupling said pilot surface with said outlet in order to provide fluid pressure from said outlet to said pilot surface, said pilot surface being configured to shift said barrel away from said wobble plate against the bias of said biasing means in accordance with fluid pressure at said outlet.

11. The pump as set forth in claim 10, said biasing means including a spring.

12. The pump as set forth in claim 11, said wobble plate being coupled with said outboard end of said piston, said pump further including a plurality of said cylinders and respective pistons, said plate being operable to stroke said pistons in sequence.

13. The pump as set forth in claim 12, further including a gerotor positioned in said housing and operable to deliver fluid from said inlet to said cylinder by way of said port.

14. The pump as set forth in claim 13, said fluid including hydraulic fluid.

15. The pump as set forth in claim 9, said flow rate ranging between about 2.6 and 0.26 gpm as said fluid pressure ranges between about 0 psi and 10,000 psi.

* * * * *